US010843015B2

(12) United States Patent
Patil et al.

(10) Patent No.: US 10,843,015 B2
(45) Date of Patent: Nov. 24, 2020

(54) SMART RESPIRATORY FACE MASK MODULE

(71) Applicant: Honeywell International Inc., Morris Plains, NJ (US)

(72) Inventors: Swapnil Gopal Patil, Thane (IN); Karl B. Schart, Coventry, RI (US); Praveen Kumar Palacharla, Hyderabad (IN); Anjaiah Tumu, Hyderabad (IN); PhaniKumar Kagithapu, Hyderabad (IN)

(73) Assignee: Honeywell International Inc., Morristown, NJ (US)

( * ) Notice: Subject to any disclaimer, the term of this patent is extended or adjusted under 35 U.S.C. 154(b) by 264 days.

(21) Appl. No.: 15/770,122

(22) PCT Filed: Oct. 22, 2015

(86) PCT No.: PCT/US2015/056804
§ 371 (c)(1),
(2) Date: Apr. 20, 2018

(87) PCT Pub. No.: WO2017/069756
PCT Pub. Date: Apr. 27, 2017

(65) Prior Publication Data

US 2018/0311517 A1 Nov. 1, 2018

(51) Int. Cl.
*A62B 27/00* (2006.01)
*A62B 18/02* (2006.01)
(Continued)

(52) U.S. Cl.
CPC ..... *A62B 27/00* (2013.01); *A62B 9/006* (2013.01); *A62B 18/02* (2013.01); *A62B 18/08* (2013.01); *A62B 18/088* (2013.01)

(58) Field of Classification Search
CPC ..... A62B 7/10; A62B 9/006; A62B 18/02; A62B 18/025; A62B 18/08; A62B 18/088; A62B 23/02; A62B 23/025; A62B 27/00
See application file for complete search history.

(56) References Cited

U.S. PATENT DOCUMENTS 4,846,166 A * 7/1989 Willeke ..... A62B 27/00 128/200.24
4,914,957 A 4/1990 Dougherty
(Continued)

FOREIGN PATENT DOCUMENTS

CN 203169862 U 9/2013
CN 103801037 A 5/2014
(Continued)

OTHER PUBLICATIONS

International Application No. PCT/US2015/056804, International Search Report, dated Jun. 22, 2016, 4 pages.
(Continued)

*Primary Examiner* — Valerie L Woodward
(74) *Attorney, Agent, or Firm* — Alston & Bird LLP

(57) ABSTRACT

A system and method for completing fit tests on a respirator mask, and indicating end of service life for one or more elements of the respirator mask. The system includes an electronics module mounted on the interior of the face mask. The module includes a pressure sensor, and possibly other sensors, such as gas sensors, temperature sensors, and humidity sensors. The module may detect the pressure on the interior of the mask during fit tests to detect any leaks in the mask. The module may be used for positive and negative pressure fit tests. Additionally, the module may include one or more indicators (lights, sounds, vibrations) for alerting a user during a fit test. The module may also detect end of
(Continued)

service life by analyzing the sensor data, and may indicate end of service life to the user.

18 Claims, 9 Drawing Sheets

(51) Int. Cl.
*A62B 18/08* (2006.01)
*A62B 9/00* (2006.01)

(56) References Cited

U.S. PATENT DOCUMENTS

| | | | | |
|---|---|---|---|---|
| 5,297,544 | A * | 3/1994 | May | A62B 18/088 128/202.22 |
| 5,313,937 | A | 5/1994 | Zdrojkowski | |
| 5,647,356 | A | 7/1997 | Osendorf et al. | |
| 5,832,916 | A | 11/1998 | Lundberg | |
| 5,860,418 | A | 1/1999 | Lundberg | |
| 8,443,806 | B2 | 5/2013 | Morelli et al. | |
| 8,528,559 | B2 | 9/2013 | Crutchfield | |
| 9,011,584 | B2 | 4/2015 | Tobias et al. | |
| 2004/0204915 | A1 | 10/2004 | Steinthal et al. | |
| 2006/0254588 | A1 | 11/2006 | Brewer et al. | |
| 2011/0227700 | A1 | 9/2011 | Hamerly et al. | |
| 2012/0055815 | A1* | 3/2012 | Truex | A62B 23/025 206/205 |
| 2013/0263857 | A1 | 10/2013 | Ahmad et al. | |
| 2014/0311211 | A1 | 10/2014 | Larsen et al. | |
| 2017/0080261 | A1* | 3/2017 | Sutton | A62B 9/006 |
| 2017/0246486 | A1* | 8/2017 | Cazier | B01D 46/0047 |

FOREIGN PATENT DOCUMENTS

| | | | |
|---|---|---|---|
| CN | 203750060 | U | 8/2014 |
| CN | 104266803 | A | 1/2015 |
| CN | 104606804 | A | 5/2015 |
| CN | 104922821 | A | 9/2015 |
| CN | 104922822 | A | 9/2015 |
| CN | 108430591 | A | 8/2018 |
| EP | 3365077 | A1 | 8/2018 |
| WO | 2017069756 | A1 | 4/2017 |

OTHER PUBLICATIONS

International Application No. PCT/US2015/056804, Written Opinion of the International Searching Authority, dated Jun. 22, 2016, 6 pages.

International Application No. PCT/US2015/056804, International Preliminary Report on Patentability, dated Apr. 24, 2018, 7 pages.

Europe Patent Application No. 15791131.4, Communication pursuant to Rules 161(1) and 162EPC, dated Jul. 27, 2018, 3 pages.

CN Office Action dated Dec. 27, 2019 for CN Application No. 201580085495.

CN Office Action dated Jun. 2, 2020 for CN Application No. 201580085495.

English Translation of CN Office Action dated Dec. 27, 2019 for CN Application No. 201580085495.

English Translation of CN Office Action dated Jun. 2, 2020 for CN Application No. 201580085495.

* cited by examiner

SMART RESPIRATORY FACE MASK MODULE

CROSS-REFERENCE TO RELATED APPLICATIONS

The present application is the National Stage of International Application No. PCT/US2015/056804 filed on Oct. 22, 2015 and entitled "Smart Respiratory Face Mask Module" which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Respirator mask may be worn by a user to protect the user's face and eyes, as well as the user's respiratory system. Respirator masks may comprise filtering cartridges, inhalation valves, exhalation valves, protective shields, and head straps. To ensure that a respirator mask is being worn correctly and protecting the user, fit tests may be conducted when the mask is first donned by a user, before the user enters a hazardous environment.

SUMMARY

Aspects of the disclosure may include embodiments of a method for completing fit testing on a mask comprising attaching an electronics module to the interior of the mask, wherein the module comprises a pressure sensor; donning the mask; establishing a wireless connection between the module and a handheld user device; displaying, by the user device, instructions for completing the negative fit test; completing a negative fit test on the mask by covering all inlet(s) to the mask, inhaling, and holding breath for approximately 10 seconds; detecting, by the module, the pressure of the interior of the mask; communicating pressure sensor data from the module to an application the user device; indicating that the negative fit test has passed when the pressure of the interior of the mask is below a negative pressure threshold; displaying, by the user device, instructions for completing the positive fit test, wherein indicating comprises displaying a message by the user device; completing a positive fit test on the mask by covering all outlet(s) to the mask, exhaling, and holding breath for approximately 10 seconds; detecting, by the module, the pressure of the interior of the mask; communicating pressure sensor data from the module to the application the user device; and indicating that the positive fit test has passed when the pressure of the interior of the mask is above a positive pressure threshold.

In some embodiments, the wireless connection comprises a Bluetooth connection. In some embodiments, the method may further comprise, when the fit tests are passed, entering into an end of service life indicator (ESLI) mode; detecting the pressure within the mask; communicating pressure sensor data from the module to the application on the user device; and indicating end of service life when the pressure exceeds an ESLI threshold. In some embodiments, the module and the application enter into ESLI mode automatically after the fit tests are passed. In some embodiments, the module and the application enter into ESLI mode when the user manually interacts with the application. In some embodiments, the module comprises a gas sensor, and the method further comprises when the fit tests are passed, entering into an end of service life indicator (ESLI) mode; detecting gas levels within the mask; communicating pressure and hazardous gas data from the module to the application on the user device; and indicating end of service life when the gas levels exceed an ESLI threshold. In some embodiments, indicating comprises activating a light, sound, or buzzer in the module. In some embodiments, indicating comprises displaying a message by the application on the user device.

Additional aspects of the disclosure may include embodiments of a method for completing fit testing on a mask comprising attaching an electronics module to the interior of the mask, wherein the module comprises a pressure sensor; donning the mask, by the user; completing a negative fit test on the mask by covering all inlet(s) to the mask, inhaling, and holding breath for approximately 10 seconds; detecting, by the module, the pressure of the interior of the mask; indicating that the negative fit test has passed when the pressure of the interior of the mask is below a negative pressure threshold; completing a positive fit test on the mask by covering all outlet(s) to the mask, exhaling, and holding breath for approximately 10 seconds; detecting, by the module, the pressure of the interior of the mask; and indicating that the positive fit test has passed when the pressure of the interior of the mask is above a positive pressure threshold.

In some embodiments, the method may further comprise establishing a wireless connection between the module and a user device; communicating pressure sensor data from the module to an application the user device; displaying, by the user device, instructions for completing the negative fit test; and displaying, by the user device, instructions for completing the positive fit test, wherein indicating comprises displaying a message by the user device. In some embodiments, the wireless connection comprises a Bluetooth connection. In some embodiments, the method may further comprise, when the fit tests are passed, entering into an end of service life indicator (ESLI) mode; detecting the pressure within the mask; and indicating end of service life when the pressure exceeds an ESLI threshold. In some embodiments, the method may further comprise establishing a connection between the module and a user device (wireless); and communicating pressure sensor data from the module to an application on the user device. In some embodiments, the module and the application enter into ESLI mode automatically after the fit tests are passed. In some embodiments, the module and the application enter into ESLI mode when the user manually interacts with the application. In some embodiments, the module comprises a gas sensor, and wherein the method further comprises, when the fit tests are passed, entering into an end of service life indicator (ESLI) mode; detecting gas levels within the mask; and indicating end of service life when the gas levels exceed an ESLI threshold. In some embodiments, indicating comprises activating a light, sound, or buzzer in the module.

Other aspects of the disclosure may include embodiments of a method for indicating end of service life for a mask comprising attaching an electronics module to the interior of the mask, wherein the module comprises a pressure sensor and a gas sensor; detecting the pressure within the mask; detecting gas levels within the mask; indicating end of service life when the pressure exceeds an ESLI threshold; and indicating end of service life when the gas levels exceed an ESLI threshold.

In some embodiments, indicating end of service life comprises activating a light, sound, or buzzer in the module. In some embodiments, the method may further comprise establishing a wireless connection between the module and a user device; communicating pressure sensor data from the module to the application on the user device; and communicating gas sensor data from the module to the application on the user device, wherein indicating end of service life comprising displaying a message by the application.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
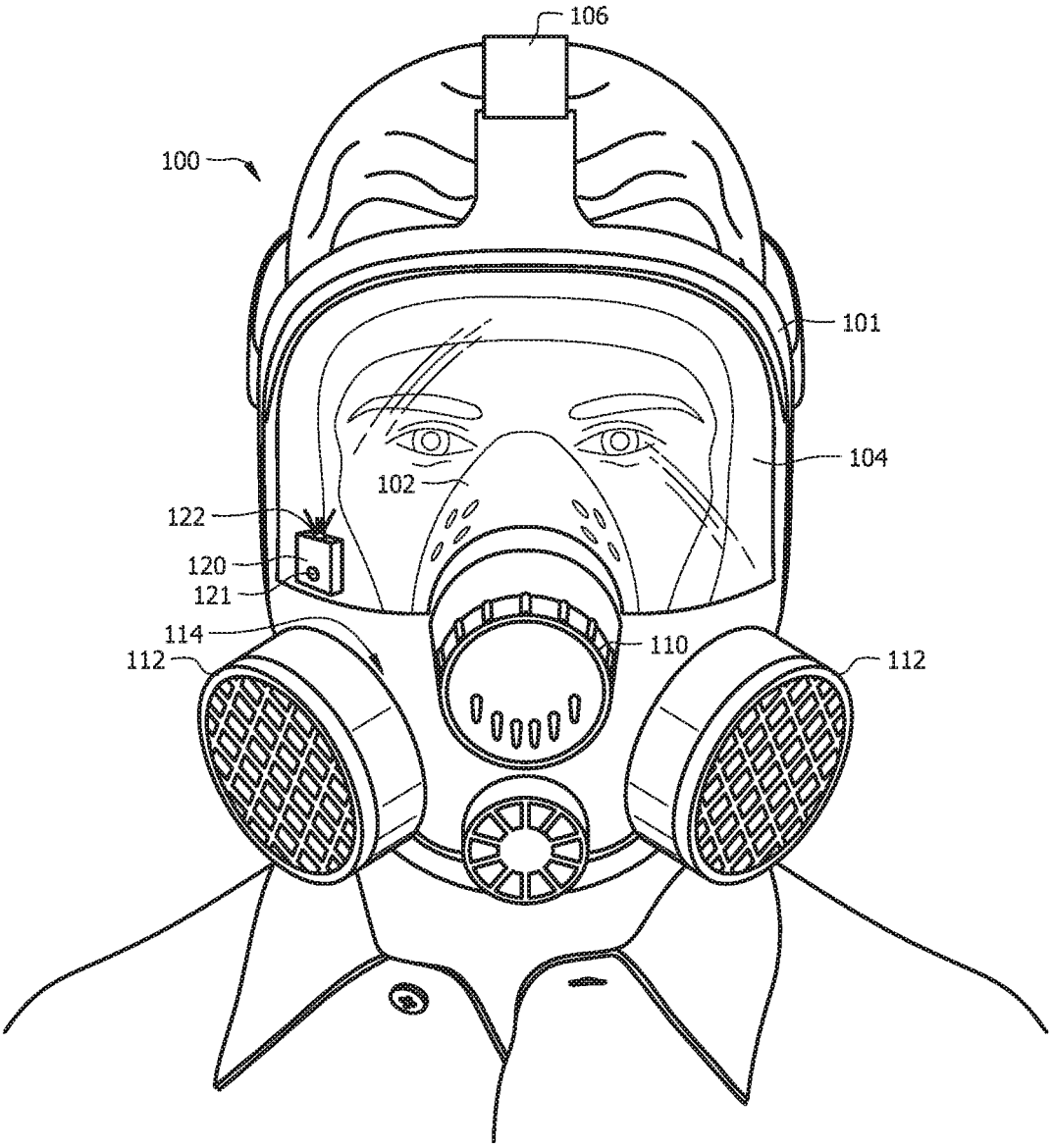
FIG. 1 illustrates a respirator mask according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments of the disclosure include systems and method for completing fit tests on a respirator mask, and indicating end of service life for one or more elements of the respirator mask. Current systems require a user to use guesswork to determine if a mask has passed a fit test or not. For example, a user may be required to detect a leakage in the mask by feel or hearing only. Small leakages into/out of a face mask may go unnoticed using this method. Additionally, current respirators may not have end of service life indicators for determining when the mask, or elements of the mask such as the cartridges, have reached end of service life and should be replaced.

Applicants propose a system comprises an electronics module mounted on the interior of the face mask, wherein the module comprises a pressure sensor, and possibly other sensors, such as gas sensors, temperature sensors, and humidity sensors. The module may detect the pressure on the interior of the mask during fit tests to detect any leaks in the mask. The module may be used for positive and negative pressure fit tests. Additionally, the module may comprise one or more indicators (lights, sounds, vibrations) for alerting a user during a fit test. The module may also detect end of service life by analyzing the sensor data, and may indicated end of service life to the user.

In some embodiments, the module may be operable to wirelessly communicate with a user's handheld device. The device may be used during fit tests to receive and analyze pressure sensor data. The device may also display instructions, and may walk a user through the steps of a fit test. Additionally, the device may continually communicate with the module to receive sensor data, analyze the data, and indicate end of service life with the sensor data exceeds end of service life thresholds.

Referring now to FIG. 1, an exemplary embodiment of a respirator mask 100 is shown. The mask 100 may comprise an oral/nasal cup 102 operable to cover the nose and mouth of a user. The cup 102 may attach to one or more cartridges 112, wherein the cartridges 112 may be attached to inhalation valves 114 on the cup 102. The cartridges 112 may filter the air breathed by the user. The cup 102 may also comprise and exhalation valve 110, wherein the user's exhaled breath may be expelled through the exhalation valve 110. In some embodiments, the inhalation valve(s) 114 and the exhalation valve 110 may be opened and closed by the pressure gradient within the cup 102 caused by the user's breathing. In some embodiments, the cup 102 may direct the user's breathing through the inhalation valve(s) 114 and exhalation valve 110. In some embodiments, the cup 102 may seal against a user's face to ensure that user is breathing through the cup 102. In other embodiments, the cup 102 may not seal against the user's face, but may only direct the user's breathing.

In some embodiments, the mask 100 may comprise an eyepiece 104 operable to protect the user's eyes and face. In some embodiments the eyepiece 104 and oral/nasal cup 102 may be attached to a frame 101, wherein the frame 101 may be held against the user's face by one or more head straps 106. In some embodiments, the frame 101 may seal against the user's face, preventing air from entering the interior of the mask 100. This may allow the user the breath only through the inhalation valve(s) 114 and exhalation valve 110, and therefore the user may also breathe filtered air that passes through the cartridges.

In some embodiments, the mask 100 may comprise an electronics module 120 attached to the mask 100. In the embodiment shown, the module 120 may be attached to the eyepiece 104 of the mask 100. In some embodiments, the module 120 may be located in a position on the mask 100 that is within the line of sight of the user. In some embodiments, the module 120 may comprise an indicator light 122. In some embodiments, the module 120 may be removably attached to the mask 100, such as with suction cups 121 or another similar attachment means. In some embodiments, the module 120 may be more permanently attached to the mask 100, such as with screws or another similar attachment means.

The electronics module 120 may comprise one or more pressure sensors and may be operable to measure the pressure levels within the mask 100. In some embodiments, the cup 102 may not seal against the user's face, and the pressure levels caused by the user's breathing may fill the interior of the mask 100. In other words, the pressure within the mask 100 may be relatively constant within the cup 102 and the eyepiece 104. Therefore, the pressure levels read by the electronics module 120 may represent the pressure within the eyepiece 104 as well as the cup 102. In some embodiments, the electronics module 120 may also comprise other sensors, such as gas sensors, temperature sensors, and humidity sensors.

Figure 2A:
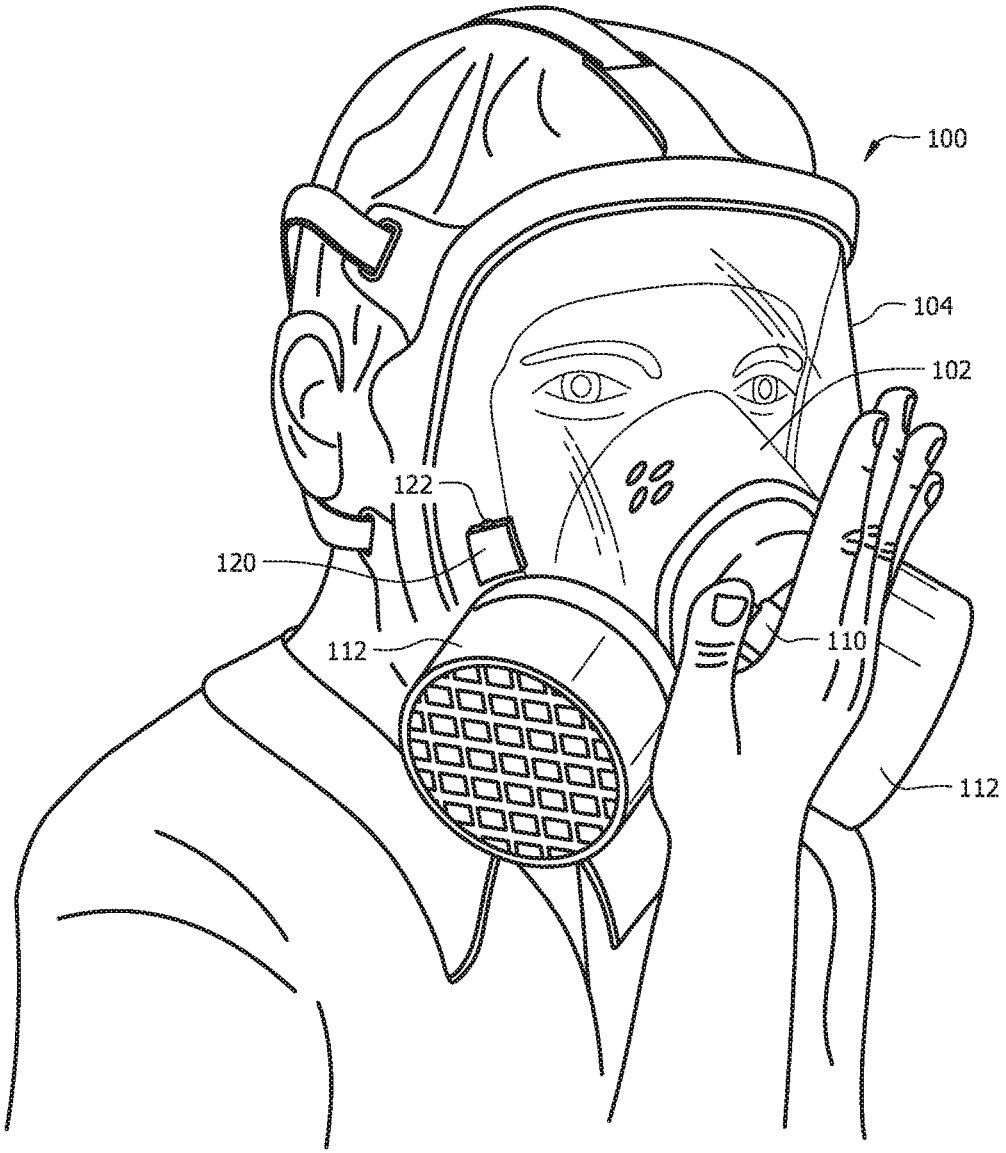
FIGS. 2A-2B illustrate the steps of a fit test according to an embodiment of the disclosure.
Figure 2B:
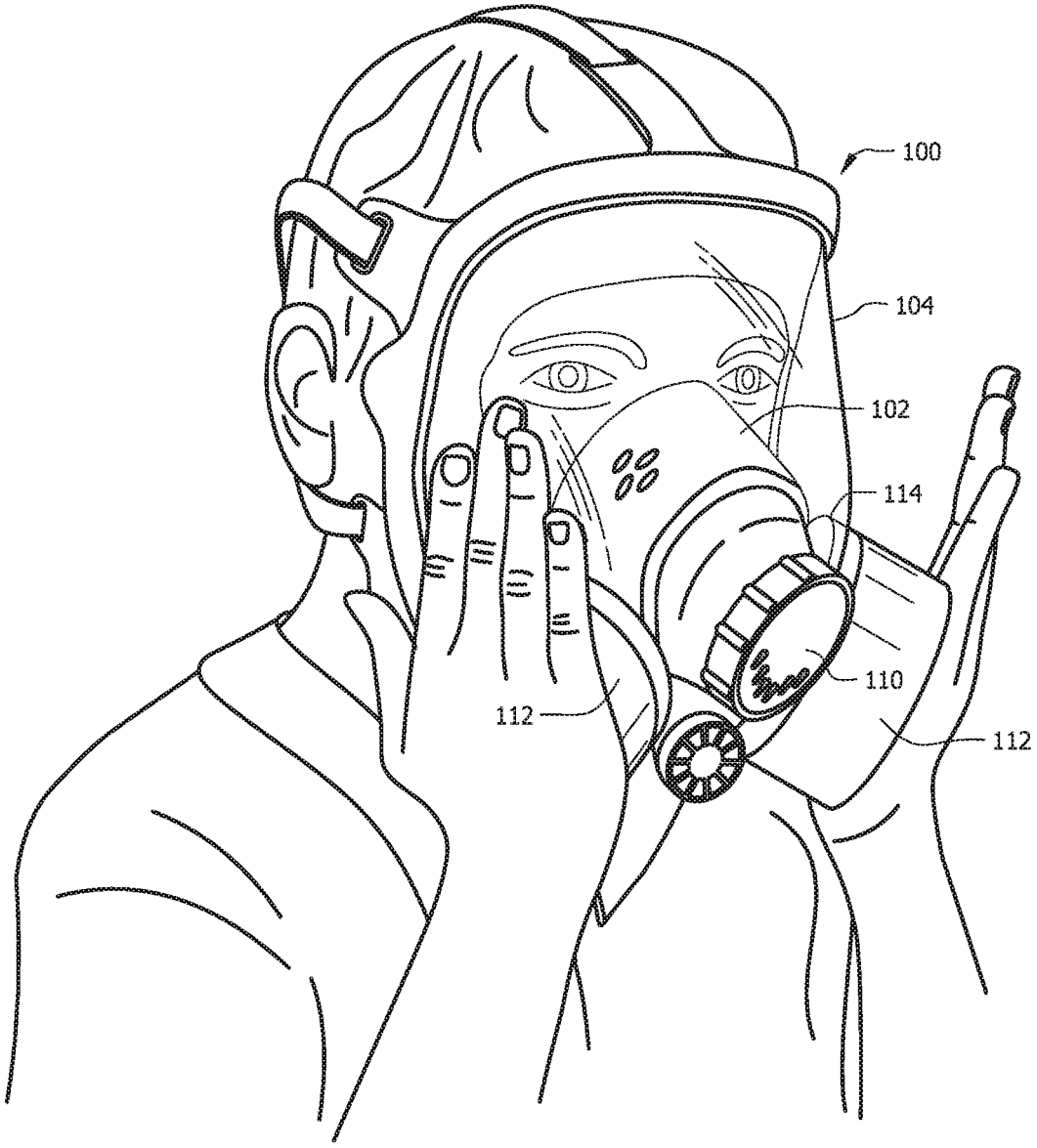

FIGS. 2A-2B illustrate the steps of completing a fit test for the mask 100. In FIG. 2A, the user may complete a positive fit test by covering the exhalation valve 110 with their hand. In some embodiments, the user may completely cover all outlets of the mask 100, wherein there are no leakholes or other ways for air to exit the interior of the mask. The user may then exhale, creating an increased pressure within the mask 100, as the exhaled air may not be able to leave the mask 100 through the exhalation valve 110 (or any other outlets). In some embodiments, the user may hold their breath for approximately 10 seconds (wherein 10 seconds may comply with an Occupational Safety and Health Administration (OSHA) or National Institute for Occupational Safety and Health (NIOSH) standard). In some embodiments, the user's hands may remain covering the outlets of the mask 100 for the entirety of the approximately 10 seconds. If the mask 100 is correctly fit against the user's face, there will be no air leakage out of the mask 100, and the increased pressure from the user's exhaled breath may be sustained while the user is holding their breath. The increased pressure may be measured by the module 120, and the fit test may pass if the pressure is stable above an exhalation threshold value (or a positive pressure threshold). In some embodiments, the positive pressure threshold may be approximately 1500 Pascals (Pa) higher than atmospheric pressure. Atmospheric pressure may vary depending on the location of the user. In some embodiments, the positive pressure threshold may be approximately 2500 Pa higher than normal breathing in the mask. In some embodiments, the positive pressure threshold may be approximately 250 Pa higher than normal breathing in the mask.

In FIG. 2B, the user may complete a negative fit test by covering the cartridges 112 (and therefore the inhalation valves 114) with their hands. In some embodiments, the user may completely cover all inlets of the mask 100, wherein there are no leakholes or other ways for air to enter the interior of the mask. The user may then inhale, creating a decreased pressure within the mask 100, as more air may not enter the mask 100 through the inhalation valve(s) 114 (or any other inlets). In some embodiments, the user may hold their breath for approximately 10 seconds (wherein 10 seconds may comply with an OSHA or NIOSH standard). In some embodiments, the user's hands may remain covering the inlets of the mask 100 for the entirety of the approximately 10 seconds. If the mask 100 is correctly fit against the user's face, there will be no air leakage into the mask 100, and the decreased pressure form the user's inhale may be sustained while the user is holding their breath. The decreased pressure may be measured by the module 120, and the fit test may pass if the pressure is stable below an inhalation threshold value (or negative pressure threshold). In some embodiments, the positive pressure threshold may be approximately 1500 Pa less than atmospheric pressure. Atmospheric pressure may vary depending on the location of the user. In some embodiments, the negative pressure threshold may be approximately 2500 Pa lower than normal breathing in the mask. In some embodiments, the negative pressure threshold may be approximately 250 Pa lower than normal breathing in the mask.

During the positive and negative fit tests, the module 120 may be continuously measuring the pressure within the mask 100. In some embodiments, if a fit tests are passed (i.e. the positive pressure is sustained above the exhalation threshold value and/or the negative pressure is sustained below the inhalation threshold value), the module 120 may indicate this to the user, such as with an indicator light and/or a vibration. In some embodiments, the positive fit test may be completed before the negative fit test, while in other embodiments, the negative fit test may be completed before the positive fit test.

The electronics module 120 may also communicate with a user's handheld device (not shown) during the fit tests, wherein the user device may receive information from the module 120, and process the information from the module 120. In some embodiments, the handheld user device may comprise a mobile device, a smart phone, a tablet, a laptop, or other similar device. In some embodiments the module 120 and the device may communicate wirelessly. In some embodiments, the device may comprise an application that comprises instructions, a step-by-step method, and/or visual indications of fit test pass or fail for a user to access during a fit test.

In some embodiments, the module 120 may also comprise a gas sensor. The gas sensor may, in some embodiments, be used as a back-up check for a fit test, wherein if the gas sensor detects harmful gas from the environment within the interior of the mask 100, a fit test may fail. In some embodiments, the module 120 may comprise an alert or indication 122 (not shown) for the user if the gas sensor detects harmful gas within the mask 100.

Referring back to FIG. 1, the electronics module 120 may also function as an end of service life indicator (ESLI). In some embodiments, the module 120 may be continuously monitoring the conditions within the mask 100 using the sensors, even after a fit test has been completed. Using information from the sensors in the module 120, it may be determined when the cartridges 112 have reached their end of service life. For example, when the cartridges 112 are filled with particulates or other filtered matter, the pressure required for a user to inhale through the cartridges 112 may increase. This increase in inhalation pressure may be detected by the module 120, wherein when an ESLI threshold is exceeded, the module 120 may indicate this to the user. In some embodiments, the ESLI threshold may be approximately 2 ppm higher than normal breathing pressure. In some embodiments, the ESLI threshold may be approximately 5 ppm higher than normal breathing pressure. In some embodiments, the ESLI threshold may be approximately 10 ppm higher than normal breathing pressure. In some embodiments, the ESLI threshold may be approximately 25 Pa higher than normal breathing pressure. In some embodiments, the ESLI threshold may be approximately 50 Pa higher than normal breathing pressure. In some embodiments, the ESLI threshold may be approximately 100 Pa higher than normal breathing pressure.

Additionally, when the filtering matter in the cartridges is used up, the cartridges 112 may fail to filter a harmful gas. A gas sensor in the module 120 may detect the presence of harmful gas in the mask, wherein when an ESLI threshold is exceeded, the module 120 may indicate this to the user. Indications may comprise lights, sounds, and/or vibrations. In some embodiments, the ESLI threshold for the gas sensor may be zero, wherein any detection of harmful gas may indicate end of service life. In some embodiments, the gas sensor may detect carbon dioxide within the mask, wherein the ESLI threshold may be higher than an acceptable baseline amount of carbon dioxide. Buildup of carbon dioxide in the mask may indicate that the user is not getting enough oxygen. In some embodiments, the gas sensor may detect organic vapors, ethanol, hydrogen, ammonia, methane, propane, and/or iso-butane, wherein the ESLI threshold may be higher than an acceptable baseline amount of one of those gases.

Figure 3:
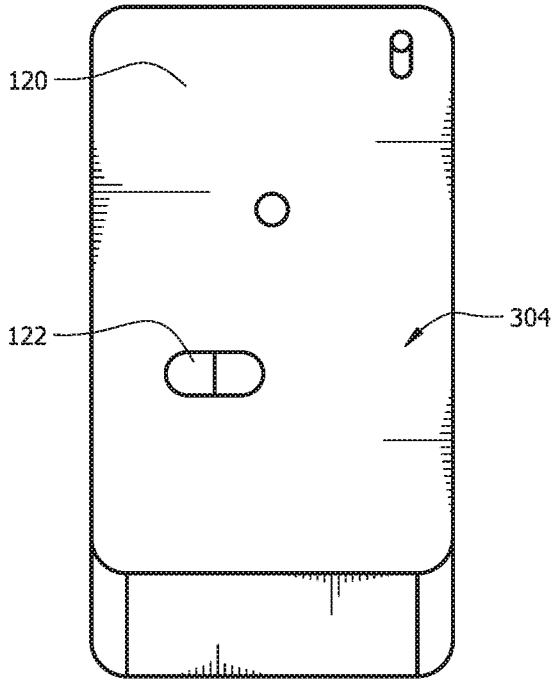
FIG. 3 illustrates an electronics module according to an embodiment of the disclosure.

FIG. 3 illustrates an exemplary embodiment of an electronics module 120. The module 120 may comprise an indicator light 122. The module may comprise a housing 304 operable to encase the elements of the module 120, which may include one or more sensors, one or more processors, wireless communication modules, and indicators.

Figure 4:
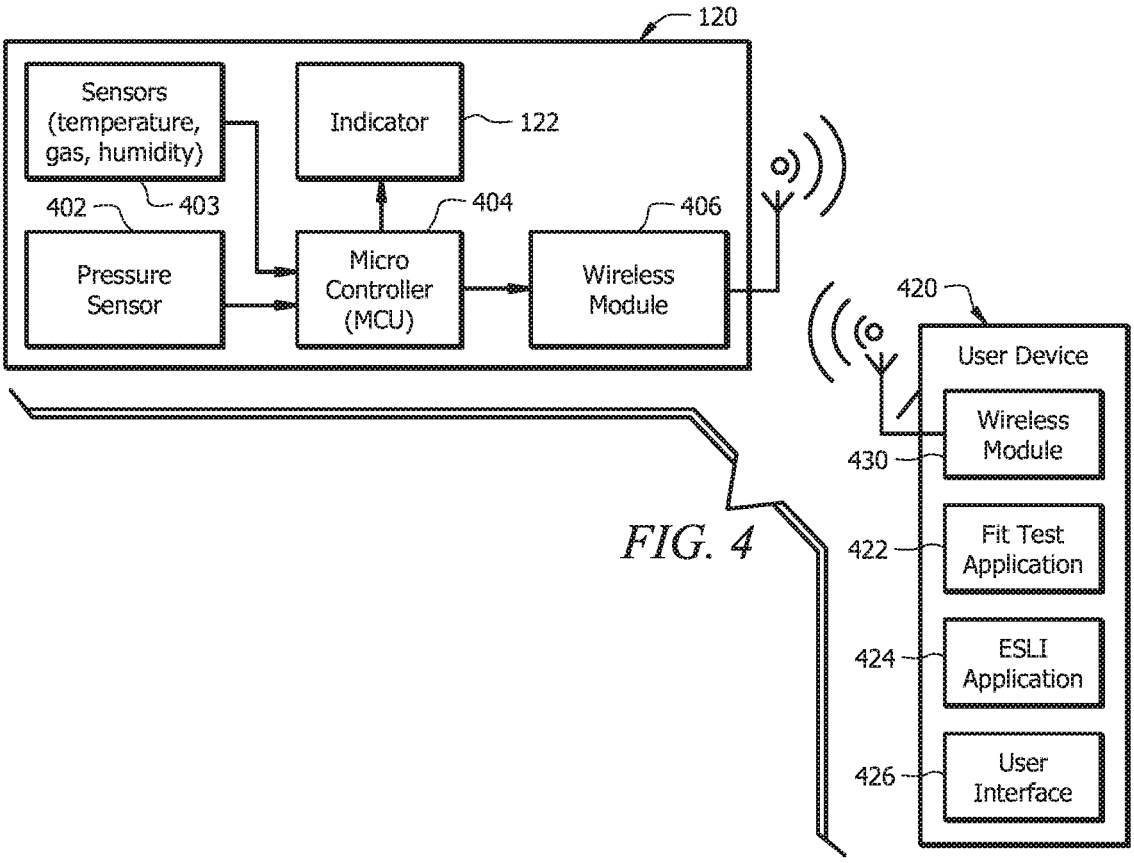
FIG. 4 illustrates the communication between an electronics module and a user device according to an embodiment of the disclosure.

FIG. 4 illustrates the communication between the electronics module 120 and a user device 420. In some embodiments, the user device 420 may comprise a handheld device. As shown in FIG. 4, the module 120 may comprise a pressure sensor 402 (which may comprise a metal-oxide-semiconductor (MOS) sensor). In some embodiments, the pressure sensor 402 may comprise an absolute pressure sensor. Additionally, the module 120 may comprise other sensors 403, such as a temperature sensor, a gas sensor, a humidity sensor, among others. The sensors 402 and 403 may communicate with a microcontroller unit (MCU) 404, which may be operable to control the communications within the module 120. In some embodiments, the MCU 404 may process the information received from the sensors 402 and 403, and may activate an indicator 122, such as a light, buzzer, or beeper. The MCU 404 may also communicate sensor information to a user device 420 via a wireless module 406, which may comprise a Bluetooth module.

In some embodiments, the user device 420 may comprise a wireless module 430, which may comprise a Bluetooth module. The wireless module 430 may facilitate communication between the electronics module 120 and the user device 420. In some embodiments, the user device 420 may comprise a fit test application 422, which may receive the sensor information from the module 120. The fit test application 422 may comprise instructions, guides, and/or methods for completing a fit test on a mask 100 (not shown), wherein the fit test application 422 may respond to information received from the electronics module 420.

Additionally, the user device 420 may comprise an ESLI application 424, wherein the ESLI application 424 may receive information from the module 120. End of service life may be indicated when one or more sensors indicate that one or more condition within the mask has exceeded an ESLI threshold (as described above). The ESLI application 424 may receive and process the information from the module 120. In some embodiments, the module 120 may process the information to determine if end of service life is indicated. In other embodiments, the module 120 may send the information to the user device 420, wherein the ESLI application may process the information to determine if end of service life is indicated. In some embodiments, the fit test application 422 and ESLI application 424 may be combined into one application on the user device 420.

In some embodiments, the user device 420 may comprise a user interface 426 for displaying information and receiving input from a user. The user interface 426 may comprise a display, buttons, touch screen, lights, sounds, buzzers, etc.

Figure 5A:
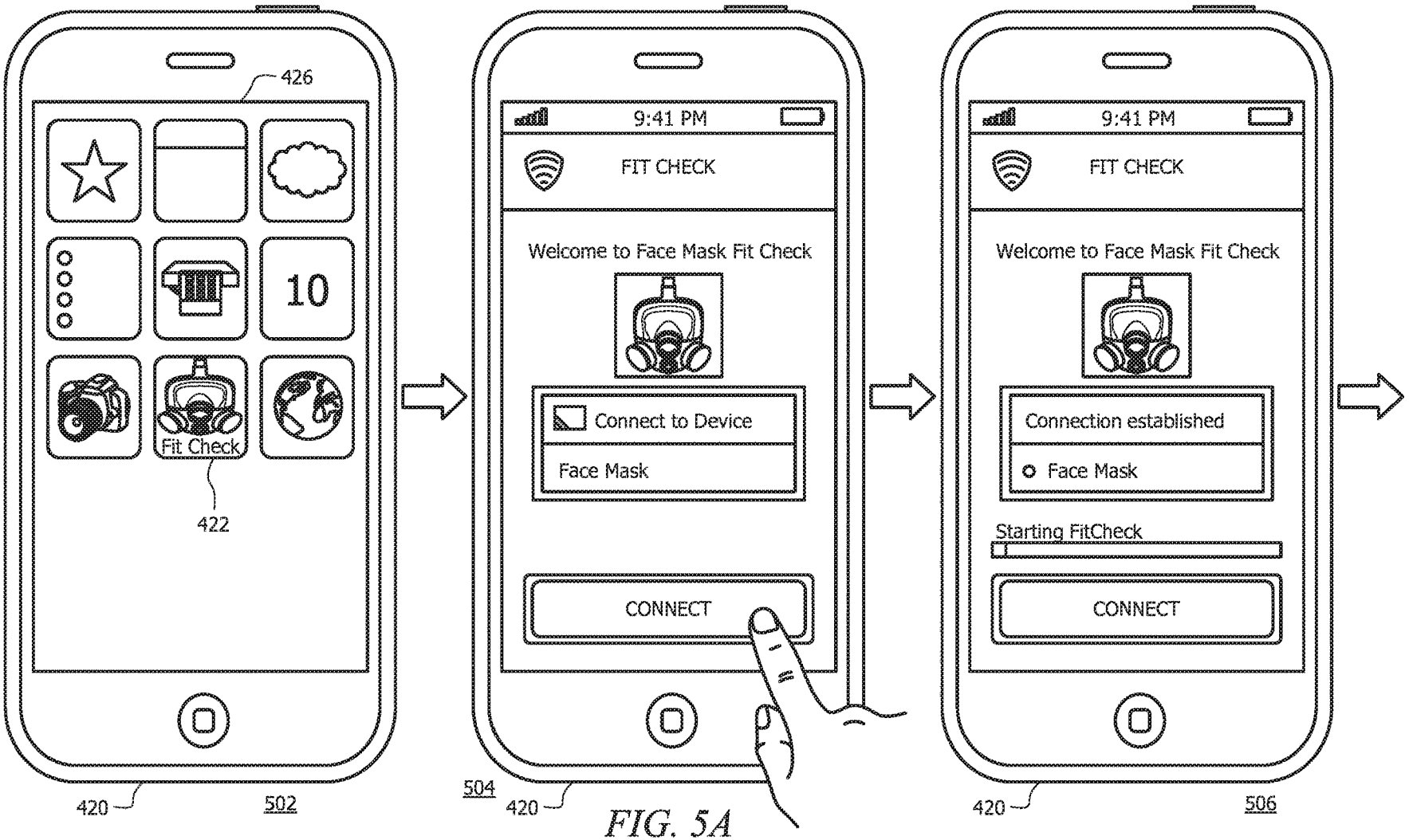
FIGS. 5A-5C illustrate an example of how a fit test application may be used according to an embodiment of the disclosure.
Figure 5B:
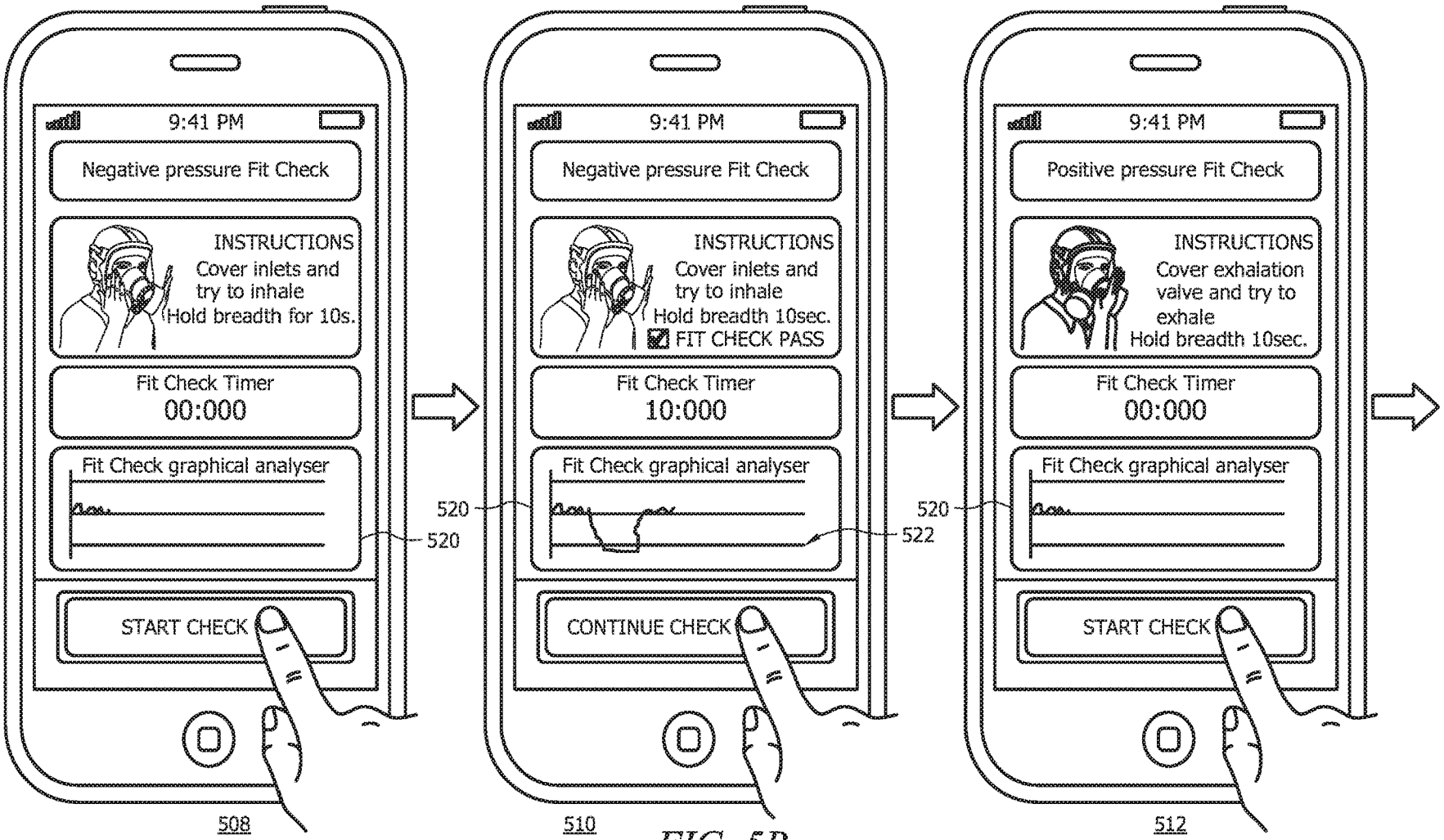
Figure 5C:
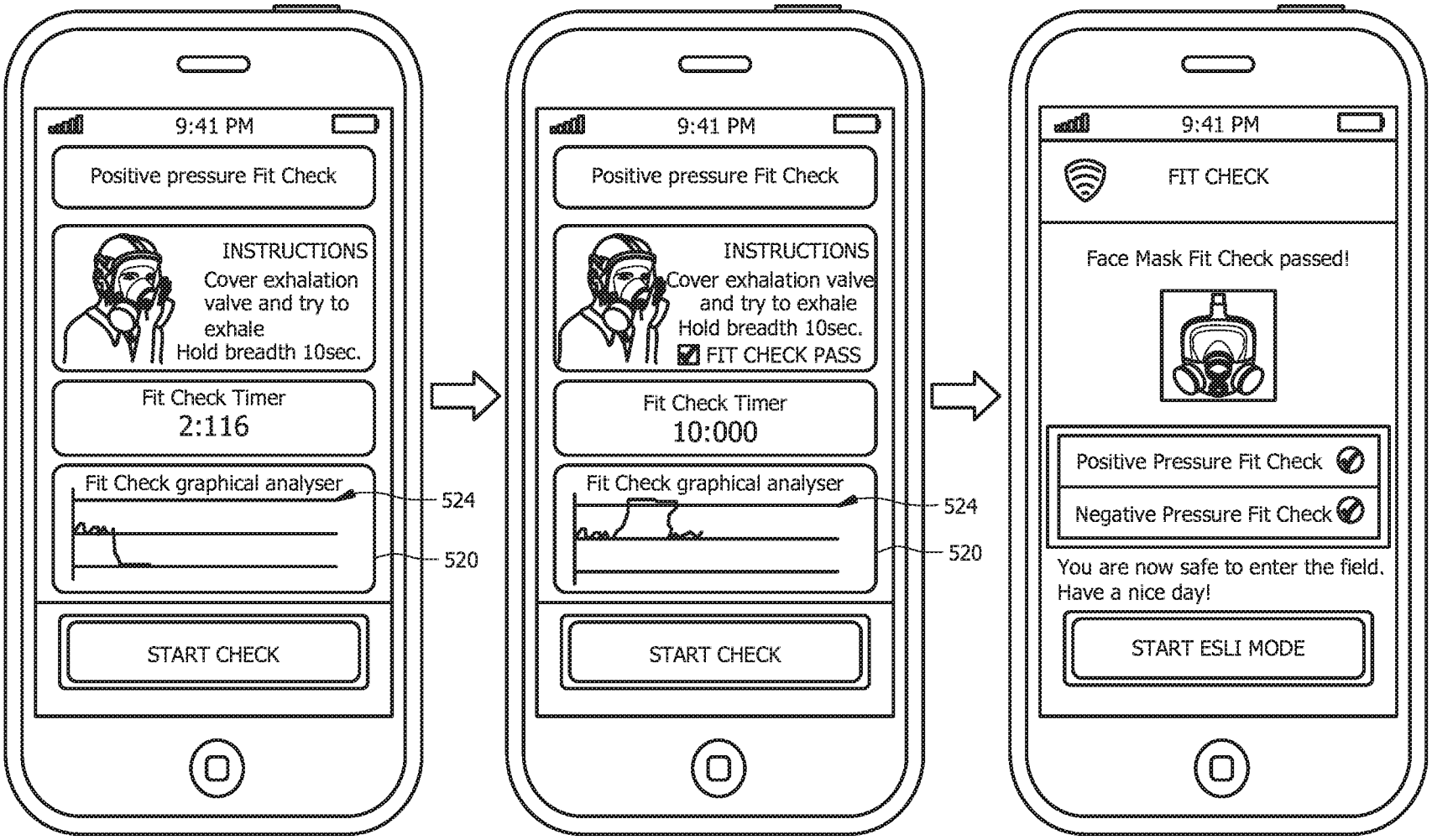

FIGS. 5A-5C illustrate an example of how the fit test application 422 may be used. At step 502, the user may open the application 422 on the user device 420 using the user interface 426.

At step 504, the user may connect the application 422 to the module 120 (not shown) on their mask. In some embodiments, the module 120 and application 422 may communicate via Bluetooth. At step 506, communication may be established between the application 422 and the module 120, and the fit test may start. At step 508, the application 422 may display instructions for a negative fit test. The user may press a "Start Check" button to start the test. Then the user may follow the instructions by placing their hands over the inlets to the mask, inhaling, and holding their breath for 10 seconds. In some embodiments, the application 422 may comprise a chart 520 that may show the pressure readings received from the module 120 (not shown). After 10 seconds have passed, if the pressure was stable below an inhalation threshold value 522 (or negative pressure threshold), the fit test may be passed. At step 510, if the fit test is passed, the user may continue the fit test.

At step 512, the application 422 may display instructions for a positive fit test. The user may press a "Start Check" button to start the test. Then the user may follow the instructions by placing their hands over the exhalation valve (or outlet) of the mask, exhaling, and holding their breath for 10 seconds. The chart 520 may show the pressure indicated by the module 120. After 10 seconds have passed, if the pressure was stable above an exhalation threshold value 524 (or positive pressure threshold), the fit test may be passed. At step 514, the mask may not pass the fit test, and the user may adjust the mask on their face to correct the fit. At step 516, the test may be completed again, and the test may be passed. The chart 520 may show the pressure readings during the test. After both a negative and positive fit test have been passed, at step 518, the application may display a "Passed" screen, and may give the user the option to enter ESLI mode.

In addition to the indications from the user device 420 during the fit testing, in some embodiments, the module 120 (not shown) may activate indicators 122 (not shown) during the fit test. For example, when a fit test is passed, a light, sounds, and/or vibration may be activated.

Figure 6:
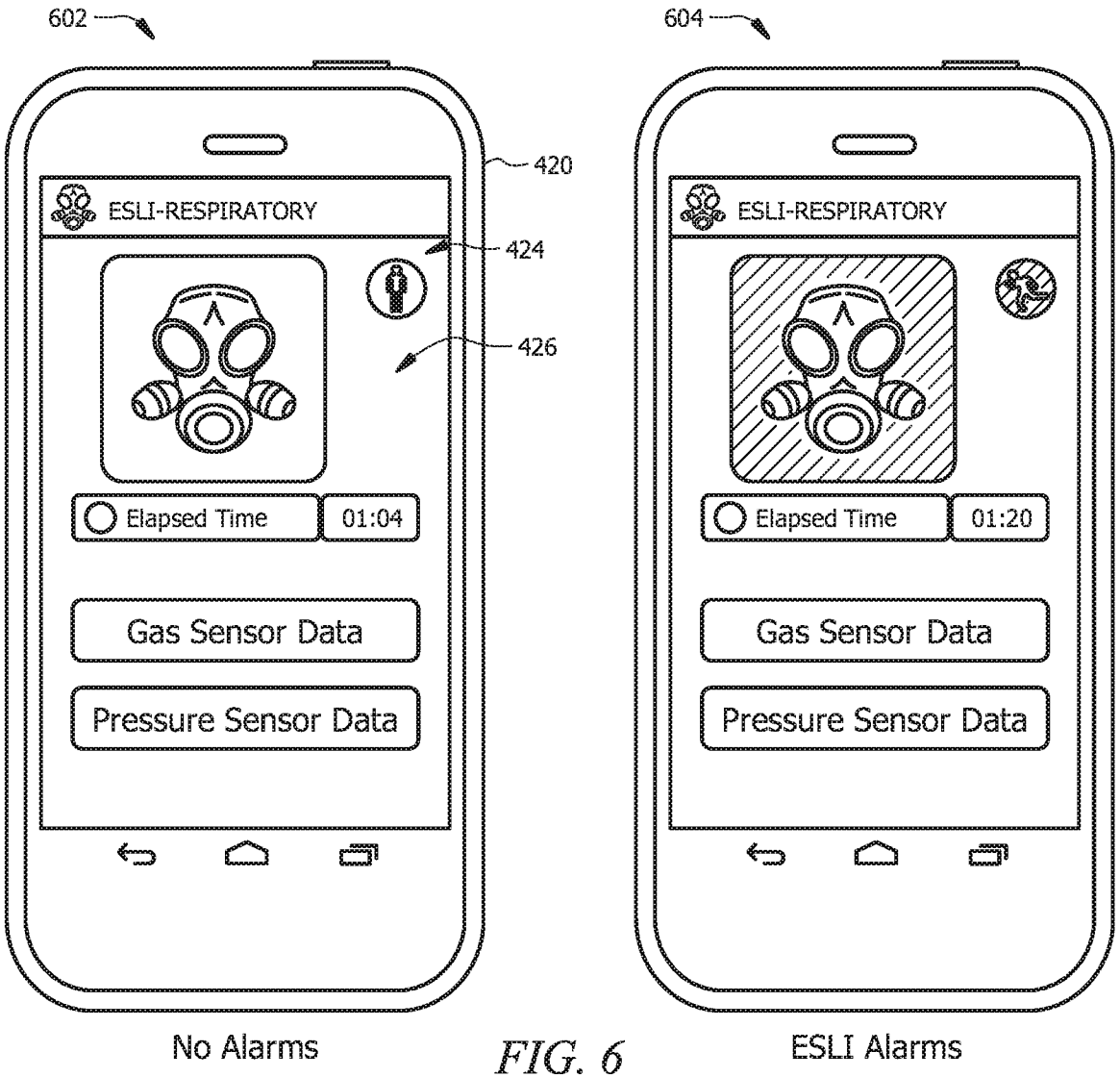
FIG. 6 illustrates an example of how an ESLI application may be used according to an embodiment of the disclosure.

FIG. 6 illustrates an example of how ESLI application 424 may be used. In some embodiments, the ESLI application 424 may be separate from the fit test application 422 (shown in FIGS. 5A-5C). In other embodiments, one application may comprise a fit test mode 422 and an ESLI mode 424.

At step 602, the ESLI application 424 may display ESLI information, such as elapsed time, gas sensor data and pressure sensor data. In some embodiments, gas sensor data may comprise gas level readings of one or more harmful gases that may be present in the environment the user is working in. In some embodiments, the pressure sensor data may comprise pressure readings from the interior of the mask. In some embodiments, the user interface 426 may display a color that indicates if the cartridges have reached end of service life. At step 604, one or more of the cartridges of the mask may have reached end of service life, as indicated by the sensors of the module 120 (not shown), and the application 424 may indicate end of service life to the user. In some embodiments, the user device 420 may comprise indicators for indicating end of service life, such as colors on the display, words on the display, sounds, and vibrations. Additionally, indicators may be activated on the electronics module 120 (not shown).

Figure 7:
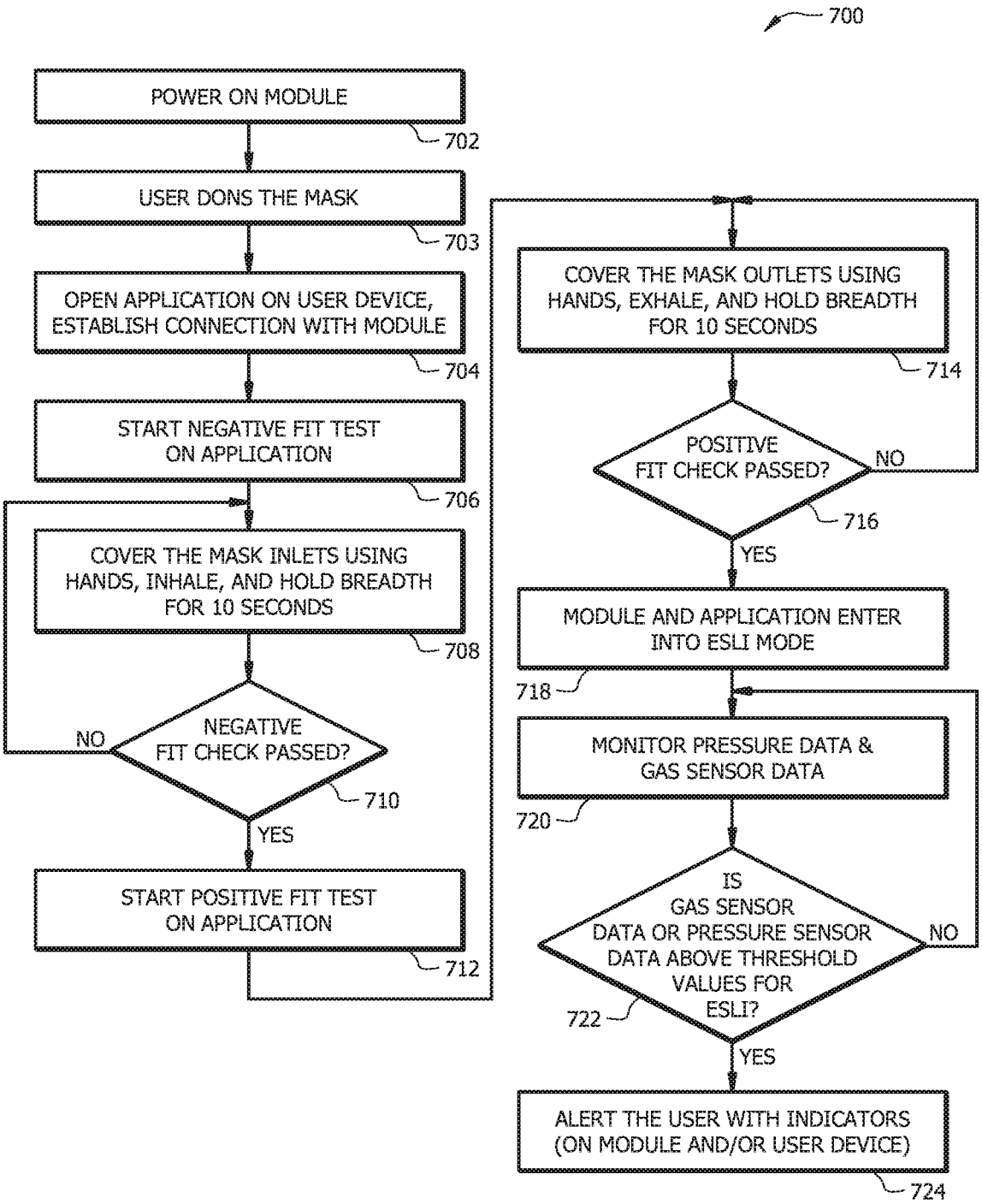
FIG. 7 illustrates a method according to an embodiment of the disclosure.

FIG. 7 illustrates a method 700 for completing a fit test with a mask and indicating end of service life for a mask using an electronics module on the interior of the mask. In some embodiments, the method 700 may comprise attaching the module to the interior of the mask. At step 702, the module on the interior of the mask may be powered on. Then, at step 703, the user may don the mask. At step 704, the user may open the application on the user device and establish a connection between the device and the module. At step 706, the user may interact with the application to start a negative fit test. Then, at step 708, the user may follow instructions displayed on the application and cover the mask inlets using their hands, inhale, and hold their breath for 10 seconds. To pass the fit test, the pressure must be below a negative pressure threshold. At step 710, it may be determined if the negative fit test was passed. If not, the method may repeat from step 708, and the negative fit test may be completed again, wherein the user may adjust the mask on their face to get a better fit. If the negative fit test is passed, the method may continue to step 712.

At step 712, the user may interact with the application to start a positive fit test. Then, at step 714, the user may follow instructions displayed on the application and cover the mask outlet(s) using their hands, exhale, and hold their breath for 10 seconds. To pass the fit test, the pressure must be above a positive pressure threshold. At step 716, it may be determined if the positive fit test was passed. If not, the method may repeat from step 714, and the positive fit test may be completed again, wherein the user may adjust the mask on their face to get a better fit. If the positive fit test is passed, the method may continue to step 718.

At step 718, the user may interact with the application to enter ESLI mode. Additionally, the module may enter into ESLI mode. In some embodiments, the module and/or application may enter ESLI mode automatically, without requiring input from the user. At step 720, the application and/or module may monitor sensor data, such as pressure sensor data and gas sensor data. In some embodiments, other sensors may also be monitored, such as temperature and humidity. At step 722, it may be determined if the sensor data has exceeded an ESLI threshold. If not, the method may repeat from step 720. If the sensor data has exceeded an ESLI threshold, at step 724, the user may be alerted via indicators, wherein the indicators may be located on the module and/or the user device. In some embodiments, the indicators may comprise display color changes, lights, sounds, and/or vibrations.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A system for completing fit testing on a mask comprising:

a face mask having inlets and outlets;

an electronics module mounted on an interior of the face mask, wherein the electronics module comprises one or more sensors configured to detect pressure on the interior of the mask; and a processor within the electronics module, wherein the electronics module is configured to:

detect the pressure of the interior of the mask during a negative fit test, wherein all the inlets to the mask are covered by a user, and the user inhales and holds their breath for approximately 10 seconds;

indicate that the negative fit test has passed when the pressure of the interior of the mask is below a negative pressure threshold;

detect the pressure of the interior of the mask during a positive fit test, wherein all the outlets from the mask are covered by the user, and the user exhales and holds their breath for approximately 10 seconds;

indicate that the positive fit test has passed when the pressure of the interior of the mask is above a positive pressure threshold; and when the fit tests are passed, enter into an end of service life indicator (ESLI) mode.

2. The system of claim 1, wherein the electronics module is further configured to:

detect the pressure within the mask;

indicate end of service life when the pressure exceeds an ESLI threshold.

3. The system of claim 1, wherein the electronics module enters into ESLI mode automatically after the fit tests are passed.

4. The system of claim 1, further comprising a user device, wherein a wireless connection is established between the electronics module and the user device, and wherein the electronics module is configured to communicate pressure sensor data from the electronics module to an application of the user device.

5. The system of claim 4, wherein the application comprises a fit test mode and an ESLI mode.

6. The system of claim 4, wherein the electronics module enters into the ESLI mode when the user manually interacts with the application.

7. The system of claim 1, wherein the electronics module further comprises a gas sensor, and wherein the electronics module is further configured to:

detect gas levels within the mask; and indicate end of service life when the gas levels exceed an ESLI threshold.

8. A method for completing fit testing on a mask comprising:

attaching an electronics module to an interior of the mask, wherein the electronics module comprises a pressure sensor, wherein the mask includes inlets and outlets;

donning the mask, by a user;

completing a negative fit test on the mask by the user covering all the inlets to the mask, inhaling, and holding their breath for approximately 10 seconds;

detecting, by the electronics module, a pressure of the interior of the mask;

indicating that the negative fit test has passed when the pressure of the interior of the mask is below a negative pressure threshold;

completing a positive fit test on the mask by the user covering all the outlets to the mask, exhaling, and holding their breath for approximately 10 seconds;

detecting, by the electronics module, the pressure of the interior of the mask;

indicating that the positive fit test has passed when the pressure of the interior of the mask is above a positive pressure threshold; and when the fit tests are passed, entering into an end of service life indicator (ESLI) mode.

9. The method of claim 8, further comprising:

establishing a wireless connection between the electronics module and a user device;

communicating pressure sensor data from the electronics module to an application of the user device;

displaying, by the user device, instructions for completing the negative fit test; and displaying, by the user device, instructions for completing the positive fit test, wherein indicating comprises displaying a message by the user device.

10. The method of claim 9, wherein the wireless connection comprises a Bluetooth connection.

11. The method of claim 9, wherein entering into the ESLI mode comprises automatically entering into the ESLI mode, by the electronics module and the application, after the fit tests are passed.

12. The method of claim 9, wherein entering into the ESLI mode comprises entering into the ESLI mode, by the electronics module and the application, when the user manually interacts with the application.

13. The method of claim 8, further comprising:

detecting the pressure within the mask; and indicating end of service life when the pressure exceeds an ESLI threshold.

14. The method of claim 13 further comprising:

establishing a wireless connection between the electronics module and a user device; and communicating pressure sensor data from the electronics module to an application on the user device.

15. The method of claim 8, wherein the electronics module comprises a gas sensor, and wherein the method further comprises:

detecting gas levels within the mask; and indicating end of service life when the gas levels exceed an ESLI threshold.

16. The method of claim 15, further comprising:

establishing a wireless connection between the electronics module and a user device; and communicating gas sensor data from the electronics module to an application on the user device.

17. The method of claim 8, wherein indicating comprises activating a light, sound, or buzzer in the electronics module for alerting a user during a fit test.

18. The method of claim 8, wherein indicating comprises displaying a message by an application on a user device.

* * * * *